US007165433B2

(12) United States Patent
Akahane et al.

(10) Patent No.: US 7,165,433 B2
(45) Date of Patent: Jan. 23, 2007

(54) METHOD OF MANUFACTURING A CHAMBER PLATE FOR A LIQUID EJECTION HEAD

(75) Inventors: Fujio Akahane, Nagano (JP); Nagamitsu Takashima, Nagano (JP); Akiharu Kurebayashi, Nagano (JP); Kazushige Hakeda, Nagano (JP); Ryoji Uesugi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/644,088

(22) Filed: Aug. 20, 2003

(65) Prior Publication Data

US 2004/0112109 A1 Jun. 17, 2004

(30) Foreign Application Priority Data

Aug. 20, 2002 (JP) ..... P2002-239560
Aug. 19, 2003 (JP) ..... P2003-207933

(51) Int. Cl.
*B21D 51/16* (2006.01)
*B21D 28/26* (2006.01)

(52) U.S. Cl. ..... 72/335; 72/339; 29/890.142

(58) Field of Classification Search ..... 72/335, 72/339, 333, 332; 29/89.142, 890.1
See application file for complete search history.

(56) References Cited

U.S. PATENT DOCUMENTS

| | | | | |
|---|---|---|---|---|
| 3,338,084 | A * | 8/1967 | Stegman, Sr. | 72/333 |
| 4,425,777 | A * | 1/1984 | Jeglinski | 72/325 |
| 4,574,445 | A * | 3/1986 | Bentin et al. | 29/890.1 |
| 5,144,709 | A * | 9/1992 | Rooney | 72/335 |
| 5,247,825 | A * | 9/1993 | Erickson | 72/339 |
| 5,485,664 | A * | 1/1996 | Huang | 29/896.2 |
| 6,260,272 | B1 * | 7/2001 | Inose et al. | 29/890.1 |

* cited by examiner

*Primary Examiner*—Daniel C. Crane
(74) *Attorney, Agent, or Firm*—Sughrue Mion, PLLC

(57) ABSTRACT

There is disclosed a method of manufacturing a chamber formation plate of a liquid ejection head. The chamber formation plate includes a first region formed with at least recess portions to be pressure generating chambers communicated with nozzles from which liquid droplets are ejected by pressure generated in the pressure generating chambers. A metal plate and a forging die are provided. A reference part is provided on the metal plate. The reference part defines a relative position between the first region and the forging die. At least one deformation absorber is provided at a second region of the metal plate where is between the first region and the reference part. At least one plastic working is performed by the forging die, with respect to the first region to form at least the recess portions, while plastic deformation of the metal plate caused by the plastic working is absorbed by the deformation absorber.

10 Claims, 15 Drawing Sheets

METHOD OF MANUFACTURING A CHAMBER PLATE FOR A LIQUID EJECTION HEAD

BACKGROUND OF THE INVENTION

The present invention relates to a liquid ejection head in which a chamber formation plate is worked by forging, and to a method of manufacturing such a liquid ejection head.

Forging work is used in various fields of products. For example, it is thought that a pressure generating chamber of a liquid ejection head is molded by forging metal material. The liquid ejection head ejects pressurized liquid from a nozzle orifice as a liquid droplet, and the heads for various liquids have been known. An ink jet recording head is representative of the liquid ejection head. Here, the related art will be described with the ink jet recording head as an example.

An ink jet recording head (hereinafter, referred to as "recording head") used as an example of a liquid ejection head is provided with a plurality of series of flow paths reaching nozzle orifices from a common ink reservoir via pressure generating chambers in correspondence with the orifices. Further, the respective pressure generating chambers need to form by a fine pitch in correspondence with a recording density to meet a request of downsizing. Therefore, a wall thickness of a partition wall for partitioning contiguous ones of the pressure generating chambers is extremely thinned. Further, an ink supply port for communicating the pressure generating chamber and the common ink reservoir is more narrowed than the pressure generating chamber in a flow path width thereof in order to use ink pressure at inside of the pressure generating chamber efficiently for ejection of ink drops.

According to a related-art recording head, a silicon substrate is preferably used in view of fabricating the pressure generating chamber and the ink supply port having such small-sized shapes with excellent dimensional accuracy. That is, a crystal surface is exposed by anisotropic etching of silicon and the pressure generating chamber or the ink supply port is formed to partition by the crystal surface.

Further, a nozzle plate formed with the nozzle orifice is fabricated by a metal board from a request of workability or the like. Further, a diaphragm portion for changing a volume of the pressure generating chamber is formed into an elastic plate. The elastic plate is of a two-layer structure constituted by pasting together a resin film onto a supporting plate made of a metal and is fabricated by removing a portion of the supporting plate in correspondence with the pressure generating chamber.

Meanwhile, according to the above-described related-art recording head, since a difference between linear expansion rates of silicon and the metal is large, in pasting together respective members of the silicon board, the nozzle plate and the elastic plate, it is necessary to adhere the respective members by taking a long time period under relatively low temperature. Therefore, enhancement of productivity is difficult to achieve to bring about a factor of increasing fabrication cost. Therefore, there has been tried to form the pressure generating chamber at the board made of the metal by plastic working, however, the working is difficult since the pressure generating chamber is extremely small and the flow path width of the ink supply port needs to be narrower than the pressure generating chamber to thereby pose a problem that improvement of production efficiency is difficult to achieve.

In these circumstances, a problem intrinsic to forging must be solved. That is, a relative position between a mother plate and a forging die must be accurately set, and if this relative position is shifted, a worked region in which groove-shaped recesses to be pressure generating chambers are press-molded is not positioned accurately on the mother plate. Accordingly, assembling accuracy at the time when a chamber formation plate is assembled as a flow path unit is lowered, and in an extreme case, there is an anxiety that a problem arises in the ejection performance of ink droplets Since the correct relative position between the mother plate and the forging die has the important role as described above, a reference hole for receiving a reference pin raised from the forging die is bored in the mother plate, and the reference pin is inserted in the reference hole so that the relative position between the mother plate and the forging die is determined.

However, when the plastic working is performed to the worked region, a plastic flow occurs in the mother plate, and there is an anxiety that the reference hole is deformed or its position is shifted by the displacement of a raw material occurring at this time. If such deformation or shift of the position occurs, the forming position of the pressure generating chamber is shifted, and a bad influence is exerted upon the assembly quality of a flow path unit and ejection performance. Alternatively, in a case where the forging die is arranged in a progressive style, there arises a problem that when the mother plate is transferred to a forging die of a next working stage, a reference pin provided in a die at that stage and the reference hole are not normally coincident with each other.

SUMMARY OF THE INVENTION

It is therefore an object of the invention to prevent deformation of a reference hole of a mother plate and prevent a relative position between the mother plate and a forging die from being misaligned, in order to manufacture a liquid jetting head with high assembling accuracy and stable ejection performance.

In order to achieve the above object, according to the invention, there is provided a method of manufacturing a chamber formation plate of a liquid ejection head, including a first region formed with at least recess portions to be pressure generating chambers communicated with nozzles from which liquid droplets are ejected by pressure generated in the pressure generating chambers, the method comprising step of:

providing a metal plate and a forging die;

providing a reference part on the metal plate, the reference part defining a relative position between the first region and the forging die;

providing at least one deformation absorber at a second region of the metal plate where is between the first region and the reference part; and performing at least one plastic working by the forging die, with respect to the first region to form at least the recess portions, while plastic deformation of the metal plate caused by the plastic working is absorbed by the deformation absorber.

When the recess portions to be the pressure chambers or the like are formed in the first region, the plastic flow of the material occurs in the metal plate in the direction in which the material moves away from the first region.

The plastic flow (deformation) of the material or the stress transmits to the deformation absorber and absorbed thereby. Accordingly, since such plastic flow of the material is not transmitted to the reference part, the deformation or shift of the position of the reference part can be prevented, so that the foregoing problem of the forming quality of the pressure generating chamber, the assembling quality of the flow path unit or the like can be solved.

Preferably, the step of providing the deformation absorber includes a step of forming a through hole in the metal plate.

In this case, the transmission of the plastic deformation causes such a deformation state that the through hole is shrunk, so that the plastic flow of the material is surely absorbed.

Preferably, the step of providing the deformation absorber includes a step of determining a shape of through hole in accordance with a condition of the plastic deformation to be caused by the plastic working.

In this case, the shape of the through hole may be made a shape having the highest absorption efficiency, for example, an elongated shape or a circular arc shape in accordance with the plastic flow state of the material, that is, the direction or amount of the flow. Therefore, the influence of the plastic deformation upon the reference part can be eliminated.

This concept may encompass a case where the number of through hole is determined in accordance with the plastic flow state of the material. In a case where a plurality of through holes are arranged between the first region and the reference part, the above described deformation absorbing function may be enhanced. Such through holes may be partly connected.

Preferably, the through hole is so formed as to extend in a direction substantially perpendicular to a direction in which the plastic deformation transmits.

In this case, the through hole hardly exhibits reaction force to the plastic flow of the material and carries out adaptive deformation absorption, which is advantageous for cutting off the influence upon the reference hole.

Preferably, the step of providing the deformation absorber is performed before the step of performing the plastic working.

In this case, when the plastic flow of the material occurs from the first region, since the deformation absorber has been already prepared, the plastic flow of the material is certainly cut off by the deformation absorber. Therefore, a factor of deforming or shifting the position of the reference part can be certainly removed.

Preferably, the step of providing the reference part and the step of providing the deformation absorber are performed simultaneously.

In this case, not only the plastic flow of the material from the first region is certainly cut off, but also a time required to form the deformation absorber and the reference part is shortened.

Even in a case where a plurality of plastic workings are performed, since the deformation absorber can receive the plastic deformation every time a plastic working is performed, the final shape or size accuracy of the first region can be maintained.

The metal plate may be provided as a continuous strip to be eventually cut into a plurality of chamber forming plates. Alternatively, the metal plate is provided as a pre-cut plate to eventually be the chamber formation plate. In this case, since the above described deforming absorption is established for each plate to be a single chamber formation plate, the desired positioning accuracy can be realized for each plate.

Preferably, the step of providing the reference part includes a step of forming a through hole to which a reference pin provided in the forging die is to be inserted. According to the secure engagement between the reference pin and the through hole, the positioning accuracy can be enhanced. Alternatively, a protrusion, a recess, a notch, a mark or the like may be adopted as the reference part in accordance with a mode of a reference member provided in the forging die.

Preferably, the recess portions are arranged at a fixed interval. In this case, since projections of the forging die for press-molding the recess portions are accordingly arranged at a fixed pitch, the amount of the plastic flow of the material caused by the press-molding becomes uniform. Thus, load of absorbing the plastic deformation at the deformation absorber is made uniform.

Here, it is preferable that the interval is 0.3 mm or less. Even when such minute portions are formed, precise forging work can be realized.

According to the invention, there is also provided a mother metal plate, to be a chamber formation plate of a liquid ejection head which is formed with at least recess portions to be pressure generating chambers communicated with nozzles from which liquid droplets are ejected by pressure generated in the pressure generating chamber, the mother plate comprising:

a first region, to be subjected to a plastic working performed by a forging die to form at least the recess portions;

a reference part, which defines a relative position between the first region and the forging die; and at least one deformation absorber provided at a second region where is between the first region and the reference part, the deformation absorber operable to absorb plastic deformation of the mother metal plate caused by the plastic working.

Preferably, the deformation absorber is a through hole. It is further preferable that the through hole is so elongated as to transverse the second region.

It is further preferable that an arcuate part is formed in an end portion of the elongated through hole.

Since the through hole is contracted or restored by the plastic flow of the material from the first region every time when the plastic working is performed, stress concentration is repeatedly applied to the end portion of the through hole. There is an anxiety that the end of the gap is cracked if the number of the repetitions becomes excessive, and in the worst case, it is broken and the working becomes impossible. Since the above arcuate portion relieves such concentration of the stress, the problem of occurrence of cracks or the like is completely solved.

It is also preferable that: the mother metal plate is formed with through holes for defining a connecting portion which is to be cut to separate the first region from the mother plate as the chamber formation plate; and a width of the through hole is larger than a width of the connecting portion.

In this case, stress, which may otherwise concentrate on the connecting portion made to have the narrow width, concentrates on the through hole with the width larger than the width of the connecting portion, so that breakage or the like of the thin connecting portion is prevented. Besides, the plastic flow can be sufficiently absorbed, and high working accuracy can be obtained.

Preferably, the metal mother plate is comprised of nickel. Since nickel has a relatively low linear expansion rate, thermal deformation degree is not so deviated from that of another parts. Further, nickel is excellent in corrosion resistance, and rich in ductility.

Preferably, the reference part is a through hole to which a reference pin provided in the forging die is to be inserted.

According to the secure engagement between the reference pin and the through hole, the positioning accuracy can be enhanced. Alternatively, a protrusion, a recess, a notch, a mark or the like may be adopted as the reference part in accordance with a mode of a reference member provided in the forging die.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE INVENTION

Embodiments of the invention will be described below with reference to the accompanying drawings. Firstly, the constitution of a liquid ejection head will be described.

Since it is preferable to apply the invention to a recording head of an ink jet recording apparatus, as an example representative of the liquid ejection head, the above recording head is shown in the embodiment.

Figure 1:
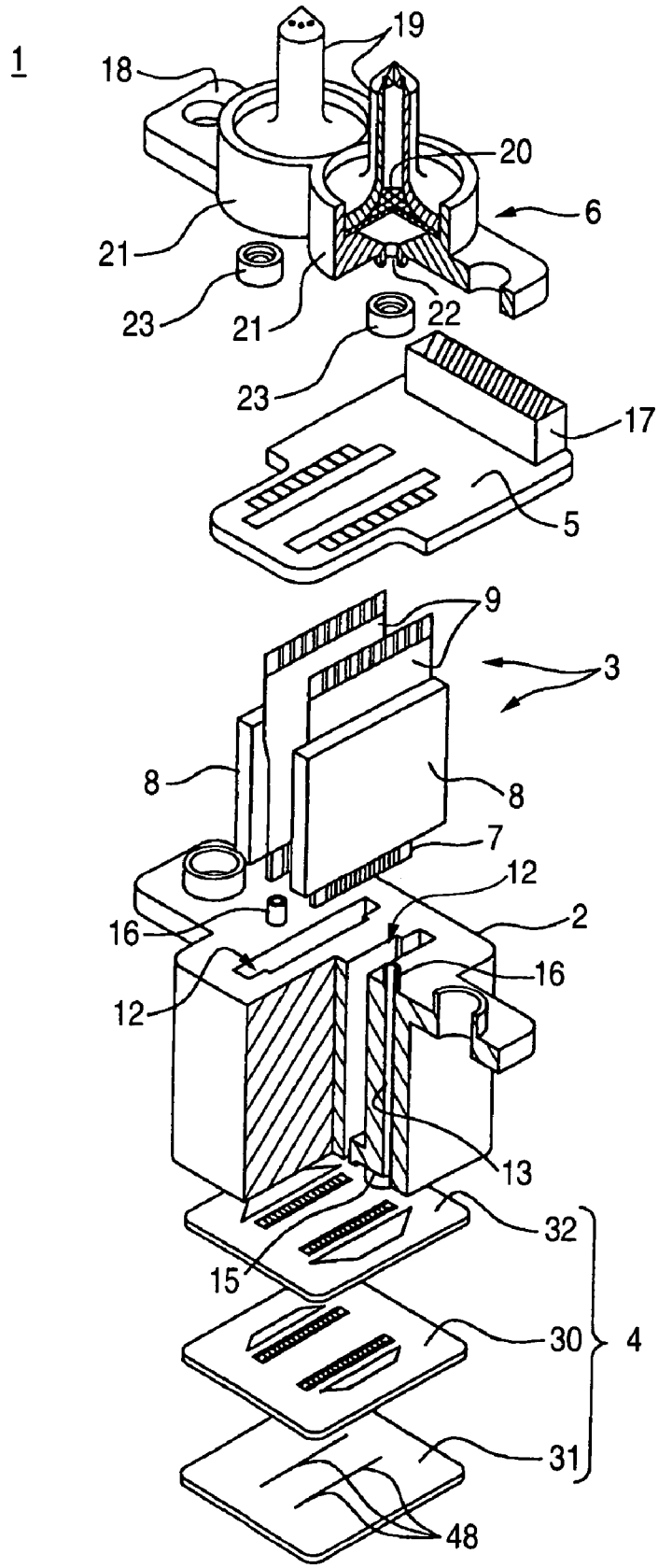
FIG. 1 is a perspective view of a disassembled ink jet recording head according to a first example.
Figure 2:
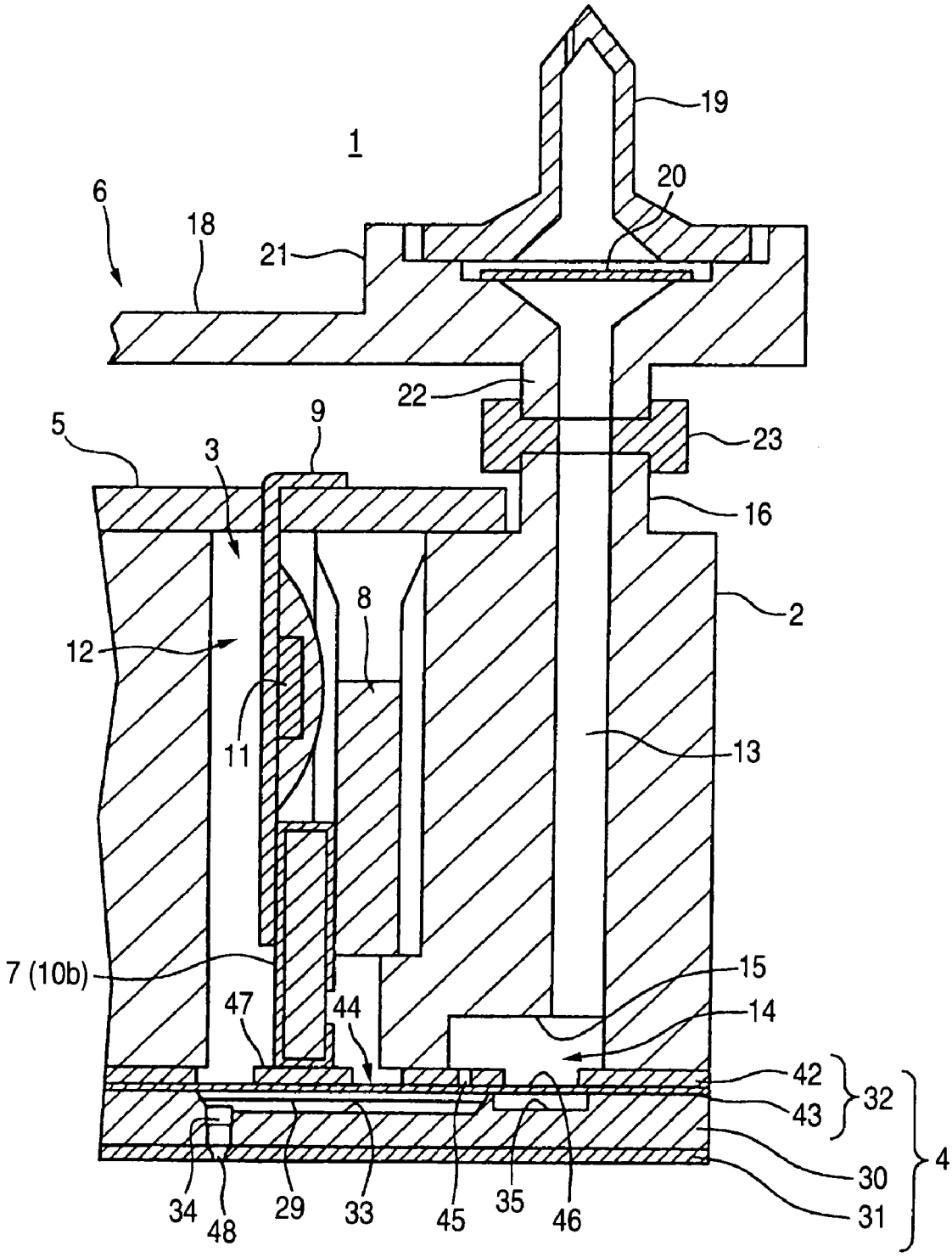
FIG. 2 is a sectional view of the ink jet recording head.

As shown in FIGS. 1 and 2, a recording head 1 is roughly constituted by a casing 2, a vibrator unit 3 contained at inside of the casing 2, a flow path unit 4 bonded to a front end face of the casing 2, a connection board 5 arranged onto a rear end face of the casing 2, a supply needle unit 6 attached to the rear end face of the casing 2.

Figure 3A:
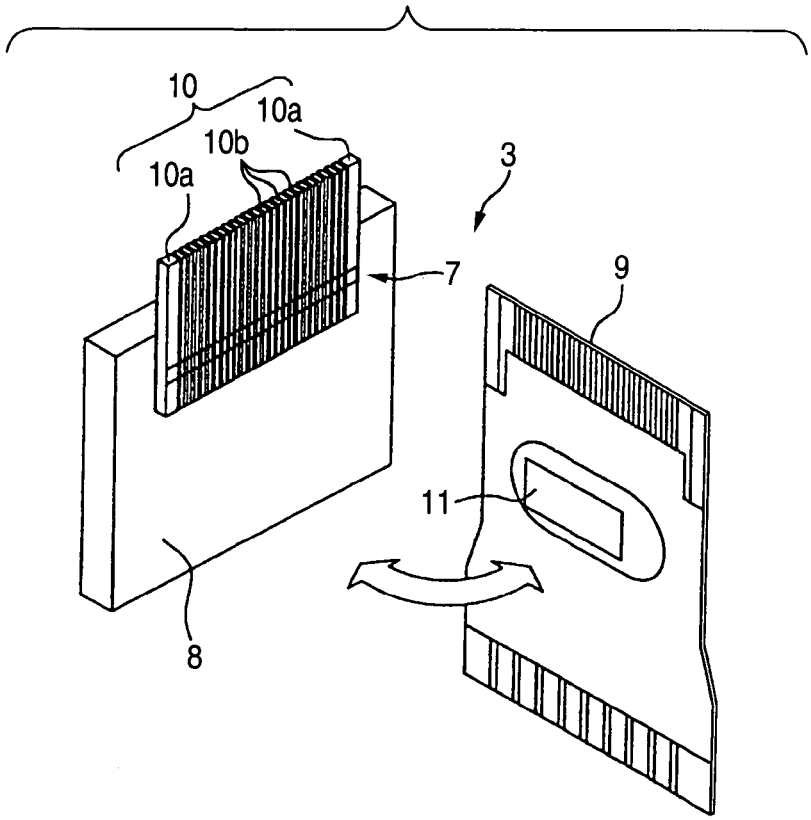
FIGS. 3A and 3B are views for explaining a vibrator unit.
Figure 3B:
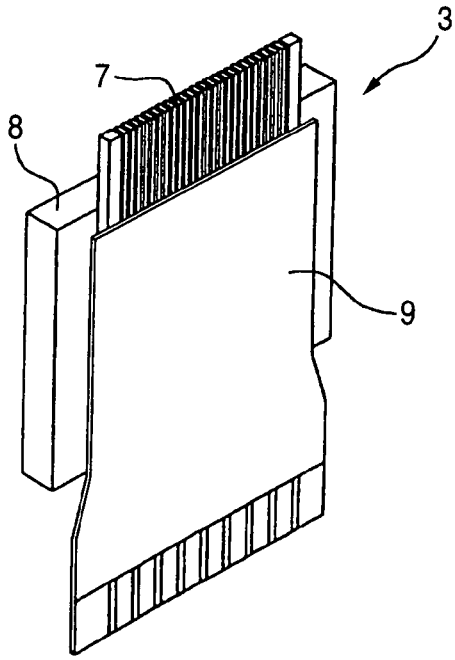

As shown in FIGS. 3A and 3B, the vibrator unit 3 is roughly constituted by a piezoelectric vibrator group 7, a fixation plate 8 bonded with the piezoelectric vibrator group 7 and a flexible cable 9 for supplying a drive signal to the piezoelectric vibrator group 7.

The piezoelectric vibrator group 7 is provided with a plurality of piezoelectric vibrators 10 formed in a shape of a row. The respective piezoelectric vibrators 10 are constituted by a pair of dummy vibrators 10*a* disposed at both ends of the row and a plurality of drive vibrators 10*b* arranged between the dummy vibrators 10*a*. Further, the respective drive vibrators 10*b* are cut to divide in a pectinated shape having an extremely slender width of, for example, about 50 μm through 100 μm, so that 180 pieces are provided.

Further, the dummy vibrator 10*a* is provided with a width sufficiently wider than that of the drive vibrator 10*b* and is provided with a function for protecting the drive vibrator 10*b* against impact or the like and a guiding function for positioning the vibrator unit 3 at a predetermined position.

A free end portion of each of the piezoelectric vibrators 10 is projected to an outer side of a front end face of the fixation plate 8 by bonding a fixed end portion thereof onto the fixation plate 8. That is, each of the piezoelectric vibrators 10 is supported on the fixation plate 8 in a cantilevered manner. Further, the free end portions of the respective piezoelectric vibrators 10 are constituted by alternately laminating piezoelectric bodies and inner electrodes so that extended and contracted in a longitudinal direction of the elements by applying a potential difference between the electrodes opposed to each other.

The flexible cable 9 is electrically connected to the piezoelectric vibrator 10 at a side face of a fixed end portion thereof constituting a side opposed to the fixation plate 8. Further, a surface of the flexible cable 9 is mounted with an IC 11 for controlling to drive the piezoelectric vibrator 10 or the like. Further, the fixation plate 8 for supporting the respective piezoelectric vibrators 10 is a plate-like member having a rigidity capable of receiving reaction force from the piezoelectric vibrators 10, and a metal plate of a stainless steel plate or the like is preferably used therefor.

The casing 2 is a block-like member molded by a thermosetting resin of an epoxy species resin or the like. Here, the casing 2 is molded by the thermosetting resin because the thermosetting resin is provided with a mechanical strength higher than that of a normal resin, a linear expansion coefficient is smaller than that of a normal resin so that deformability depending on the environmental temperature is small. Further, inside of the casing 2 is formed with a container chamber 12 capable of containing the vibrator unit 3, and an ink supply path 13 constituting a portion of a flow path of ink. Further, the front end face of the casing 2 is formed with a recess 15 for constituting a common ink reservoir 14.

The container chamber 12 is a hollow portion having a size of capable of containing the vibrator unit 3. At a portion of a front end side of the container chamber 12, a step portion is formed such that a front end face of the fixation plate 8 is brought into contact therewith.

The recess 15 is formed by partially recessing the front end face of the casing 2 so has to have a substantially trapezoidal shape formed at left and right outer sides of the container chamber 12.

The ink supply path 13 is formed to penetrate the casing 2 in a height direction thereof so that a front end thereof communicates with the recess 15. Further, a rear end portion of the ink supply path 13 is formed at inside of a connecting port 16 projected from the rear end face of the casing 2.

The connection board 5 is a wiring board formed with electric wirings for various signals supplied to the recording head 1 and provided with a connector 17 capable of connecting a signal cable. Further, the connection board 5 is arranged on the rear end face of the casing 2 and connected with electric wirings of the flexible cable 9 by soldering or the like. Further, the connector 17 is inserted with a front end of a signal cable from a control apparatus (not illustrated).

The supply needle unit 6 is a portion connected with an ink cartridge (not illustrated) and is roughly constituted by a needle holder 18, an ink supply needle 19 and a filter 20.

The ink supply needle 19 is a portion inserted into the ink cartridge for introducing ink stored in the ink cartridge. A distal end portion of the ink supply needle 19 is sharpened in a conical shape to facilitate to insert into the ink cartridge. Further, the distal end portion is bored with a plurality of ink introducing holes for communicating inside and outside of the ink supply needle 19. Further, since the recording head according to the embodiment can eject two kinds of inks, two pieces of the ink supply needles 19 are provided.

The needle holder 18 is a member for attaching the ink supply needle 19, and a surface thereof is formed with base seats 21 for two pieces of the ink supply needles 19 for fixedly attaching proximal portions of the ink supply needles 19. The base seat 21 is fabricated in a circular shape in compliance with a shape of a bottom face of the ink supply needle 19. Further, a substantially central portion of the bottom face of the base seat is formed with an ink discharge port 22 penetrated in a plate thickness direction of the needle holder 18. Further, the needle holder 18 is extended with a flange portion in a side direction.

The filter 20 is a member for hampering foreign matters at inside of ink such as dust, burr in dieing and the like from passing therethrough and is constituted by, for example, a metal net having a fine mesh. The filter 20 is adhered to a filter holding groove formed at inside of the base seat 21.

Further, as shown in FIG. 2, the supply needle unit 6 is arranged on the rear end face of the casing 2. In the arranging state, the ink discharge port 22 of the supply needle unit 6 and the connecting port 16 of the casing 2 are communicated with each other in a liquid tight state via a packing 23.

Next, the above-described flow path unit 4 will be explained. The flow path unit 4 is constructed by a constitution in which a nozzle plate 31 is bonded to one face of a chamber formation plate 30 and an elastic plate 32 is bonded to other face of the chamber formation plate 30.

Figure 4:
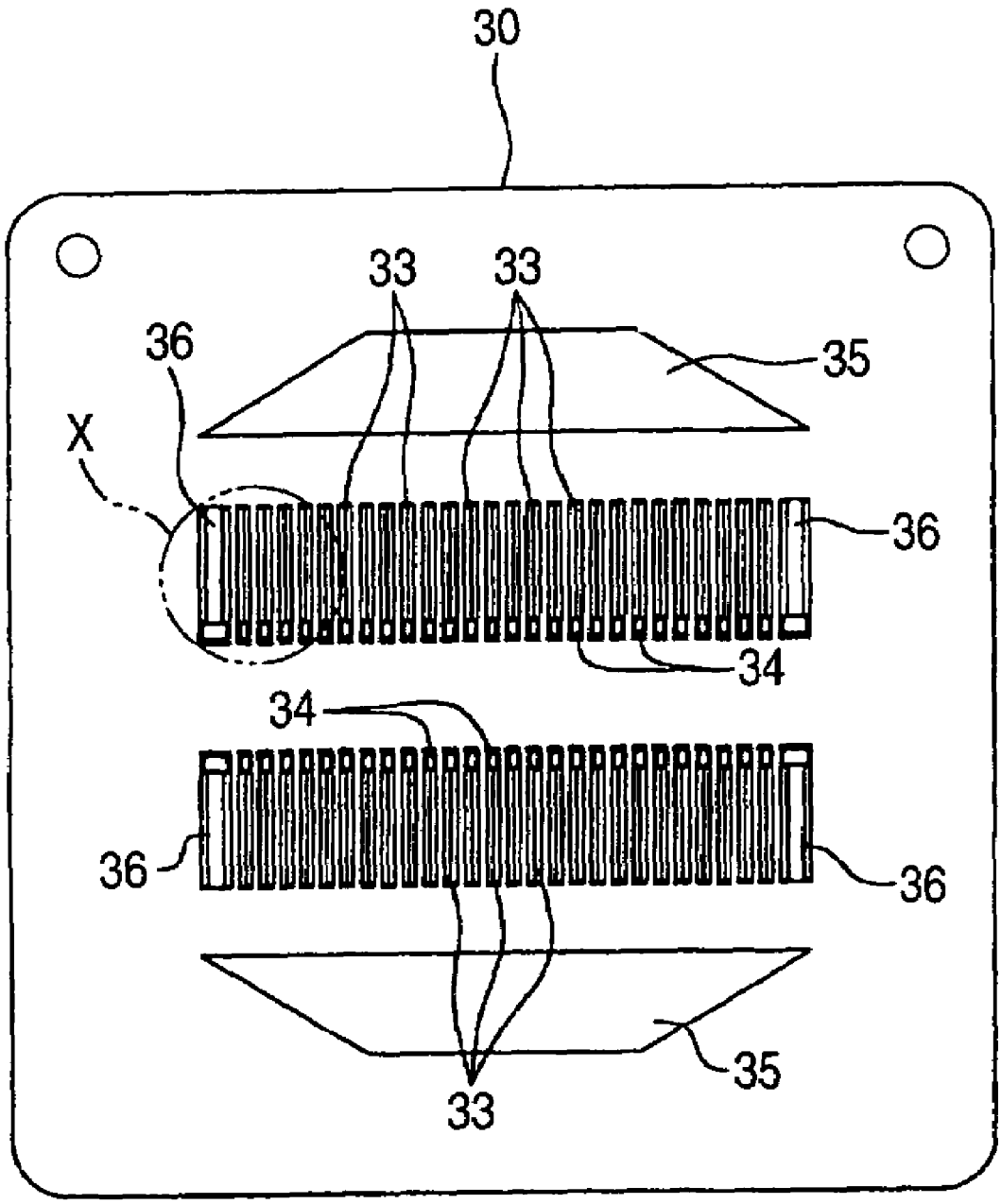
FIG. 4 is a plan view of a chamber formation plate.

As shown in FIG. 4, the chamber formation plate 30 is a plate-like member made of a metal formed with an elongated recess portion 33, a communicating port 34 and an escaping recess portion 35. According to the embodiment, the chamber formation plate 30 is fabricated by working a metal substrate made of nickel having a thickness of 0.35 mm.

An explanation will be given here of reason of selecting nickel of the metal substrate. First reason is that the linear expansion coefficient of nickel is substantially equal to a linear expansion coefficient of a metal (stainless steel in the embodiment as mentioned later) constituting essential portions of the nozzle plate 31 and the elastic plate 32. That is, when the linear expansion coefficients of the chamber formation plate 30, the elastic plate 32 and the nozzle plate 31 constituting the flow path unit 4 are substantially equal, in heating and adhering the respective members, the respective members are uniformly expanded.

Therefore, mechanical stress of warping or the like caused by a difference in the expansion rates is difficult to generate. As a result, even when the adhering temperature is set to high temperature, the respective members can be adhered to each other without trouble. Further, even when the piezoelectric vibrator 10 generates heat in operating the recording had 1 and the flow path unit 4 is heated by the heat, the respective members 30, 31 and 32 constituting the flow path unit 4 are uniformly expanded. Therefore, even when heating accompanied by activating the recording head 1 and cooling accompanied by deactivating are repeatedly carried out, a drawback of exfoliation or the like is difficult to be brought about in the respective members 30, 31 and 32 constituting the flow path unit 4.

Second reason is that nickel is excellent in corrosion resistance. That is, aqueous ink is preferably used in the recording head 1 of this kind, it is important that alteration of rust or the like is not brought about even when the recording head 1 is brought into contact with water over a long time period. In this respect, nickel is excellent in corrosion resistance similar to stainless steel and alteration of rust or the like is difficult to be brought about.

Third reason is that nickel is rich in ductility. That is, in manufacturing the chamber formation plate 30, as mentioned later, the fabrication is carried out by plastic working (for example, forging). Further, the elongated recess portion 33 and the communicating port 34 formed in the chamber formation plate 30 are of extremely small shapes and high dimensional accuracy is requested therefor. When nickel is used for the metal substrate, since nickel is rich in ductility, the elongated recess portion 33 and the communicating port 34 can be formed with high dimensional accuracy even by plastic working.

Further, with regard to the chamber formation plate 30, the chamber formation plate 30 may be constituted by a metal other than nickel when the condition of the linear expansion coefficient, the condition of the corrosion resistance and the condition of the ductility are satisfied.

Figure 5A:
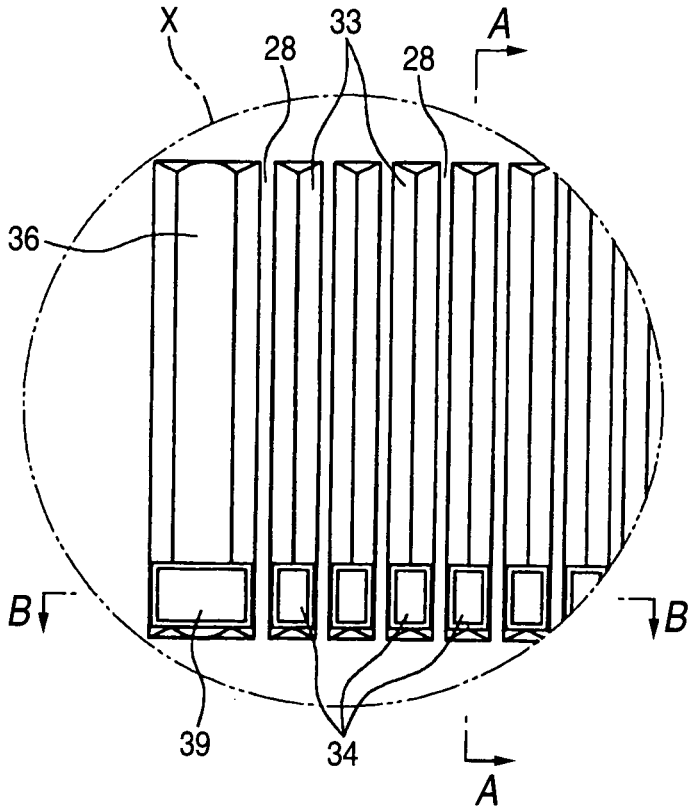
FIG. 5A is a view enlarging an X portion in FIG. 4.
Figure 5B:
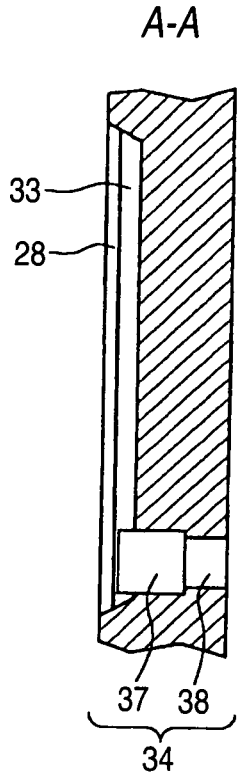
FIG. 5B is a sectional view taken along a line A—A of FIG. 5A.
Figure 5C:
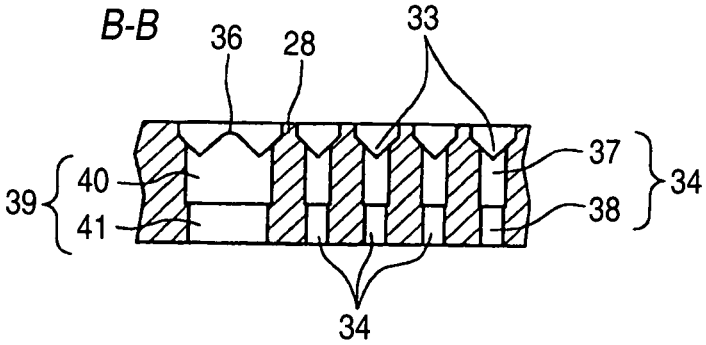
FIG. 5C is a sectional view taken along a line B—B of FIG. 5A.

The elongated recess portion 33 is a recess portion in a groove-like shape constituting a pressure generating chamber 29 and is constituted by a groove in a linear shape as shown to enlarge in FIG. 5A. According to the embodiment, 180 pieces of grooves each having a width of about 0.1 mm, a length of about 1.5 mm and a depth of about 0.1 mm are aligned side by side. A bottom face of the elongated recess portion 33 is recessed in a V-like shape by reducing a width thereof as progressing in a depth direction (that is, depth side). The bottom face is recessed in the V-like shape to increase a rigidity of a partition wall 28 for partitioning the contiguous pressure generating chambers 29. That is, by recessing the bottom face in the V-like shape, a wall thickness of the proximal portion of the partition wall 28 is thickened to increase the rigidity of the partition wall 28. Further, when the rigidity of the partition wall 28 is increased, influence of pressure variation from the contiguous pressure generating chamber 29 is difficult to be effected. That is, a variation of ink pressure from the contiguous pressure generating chamber 29 is difficult to transmit. Further, by recessing the bottom face in the V-like shape, the elongated recess portion 33 can be formed with excellent dimensional accuracy by plastic working (to be mentioned later). Further, an angle between the inner faces of the recess portion 33 is, for example, around 90 degrees although prescribed by a working condition, Further, since a wall thickness of a distal end portion of the partitioning wall 28 is extremely thin, even when the respective pressure generating chambers 29 are densely formed, a necessary volume can be ensured.

Both longitudinal end portions of the elongated recess portion 33 are sloped downwardly to inner sides as progressing to the depth side. The both end portions are constituted in this way to form the elongated recess portion 33 with excellent dimensional accuracy by plastic working.

Further, contiguous to the elongated recess portion 33 at the both ends of the row, there are formed single ones of dummy recesses 36 having a width wider than that of the elongated recess portion 33. The dummy recess portion 36 is a recess portion in a groove-like shape constituting a dummy pressure generating chamber which is not related to ejection of ink drops. The dummy recess portion 36 according to the embodiment is constituted by a groove having a width of about 0.2 mm, a length of about 1.5 mm and a depth of about 0.1 mm. Further, a bottom face of the dummy recess portion 36 is recessed in a W-like shape. This is also for increasing the rigidity of the partition wall 28 and forming the dummy recess portion 36 with excellent dimensional accuracy by plastic working.

Further, a row of recesses is constituted by the respective elongated recess portions 33 and the pair of dummy recess portions 36. According to the embodiment, two rows of the recesses are formed as shown in FIG. 4.

The communicating port 34 is formed as a small through hole penetrating from one end of the elongated recess portion 33 in a plate thickness direction. The communicating ports 34 are formed for respective ones of the elongated recess portions 33 and are formed by 180 pieces in a single recess portion row. The communicating port 34 of the embodiment is in a rectangular shape in an opening shape thereof and is constituted by a first communicating port 37 formed from a side of the elongated recess portion 33 to a middle in the plate thickness direction in the chamber formation plate 30 and a second communicating port 38 formed from a surface thereof on a side opposed to the elongated recess portion 33 up to a middle in the plate thickness direction.

Further, sectional areas of the first communicating port 37 and the second communicating port 38 differ from each other and an inner dimension of the second communicating port 38 is set to be slightly smaller than an inner dimension of the first communicating port 37. This is caused by manufacturing the communicating port 34 by pressing. The chamber formation plate 30 is fabricated by working a nickel plate having a thickness of 0.35 mm, a length of the communicating port 34 becomes equal to or larger than 0.25 mm even when the depth of the recess portion 33 is subtracted. Further, the width of the communicating port 34 needs to be narrower than the groove width of the elongated recess portion 33, set to be less than 0.1 mm. Therefore, when the communicating port 34 is going to be punched through by a single time of working, a male die (punch) is buckled due to an aspect ratio thereof.

Therefore, in the embodiment, the working is divided into two steps. In the first step, the first communicating port 37 is formed halfway in the plate thickness direction, and in the second step, the second communicating port 38 is formed. The working process of this communicating port 34 will be described later.

Further, the dummy recess portion 36 is formed with a dummy communicating port 39. Similar to the above-described communicating port 34, the dummy communicating port 39 is constituted by a first dummy communicating port 40 and a second dummy communicating port 41 and an inner dimension of the second dummy communicating port 41 is set to be smaller than an inner dimension of the first dummy communicating port 40.

Further, although according to the embodiment, the communicating port 34 and the dummy communicating port 39 opening shapes of which are constituted by small through holes in a rectangular shape are exemplified, the invention is not limited to the shape. For example, the shape may be constituted by a through hole opened in a circular shape or a through hole opened in a polygonal shape.

The escaping recess portion 35 forms an operating space of a compliance portion 46 (described later) in the common ink reservoir 14. According to the embodiment, the escaping recess portion 35 is constituted by a recess portion in a trapezoidal shape having a shape substantially the same as that of the recess 15 of the casing 2 and a depth equal to that of the elongated recess portion 33.

Next, the above-described elastic plate 32 will be explained. The elastic plate 32 is a kind of a sealing plate of the invention and is fabricated by, for example, a composite material having a two-layer structure laminating an elastic film 43 on a support plate 42. According to the embodiment, a stainless steel plate is used as the support plate 42 and PPS (polyphenylene sulphide) is used as the elastic film 43.

Figure 6:
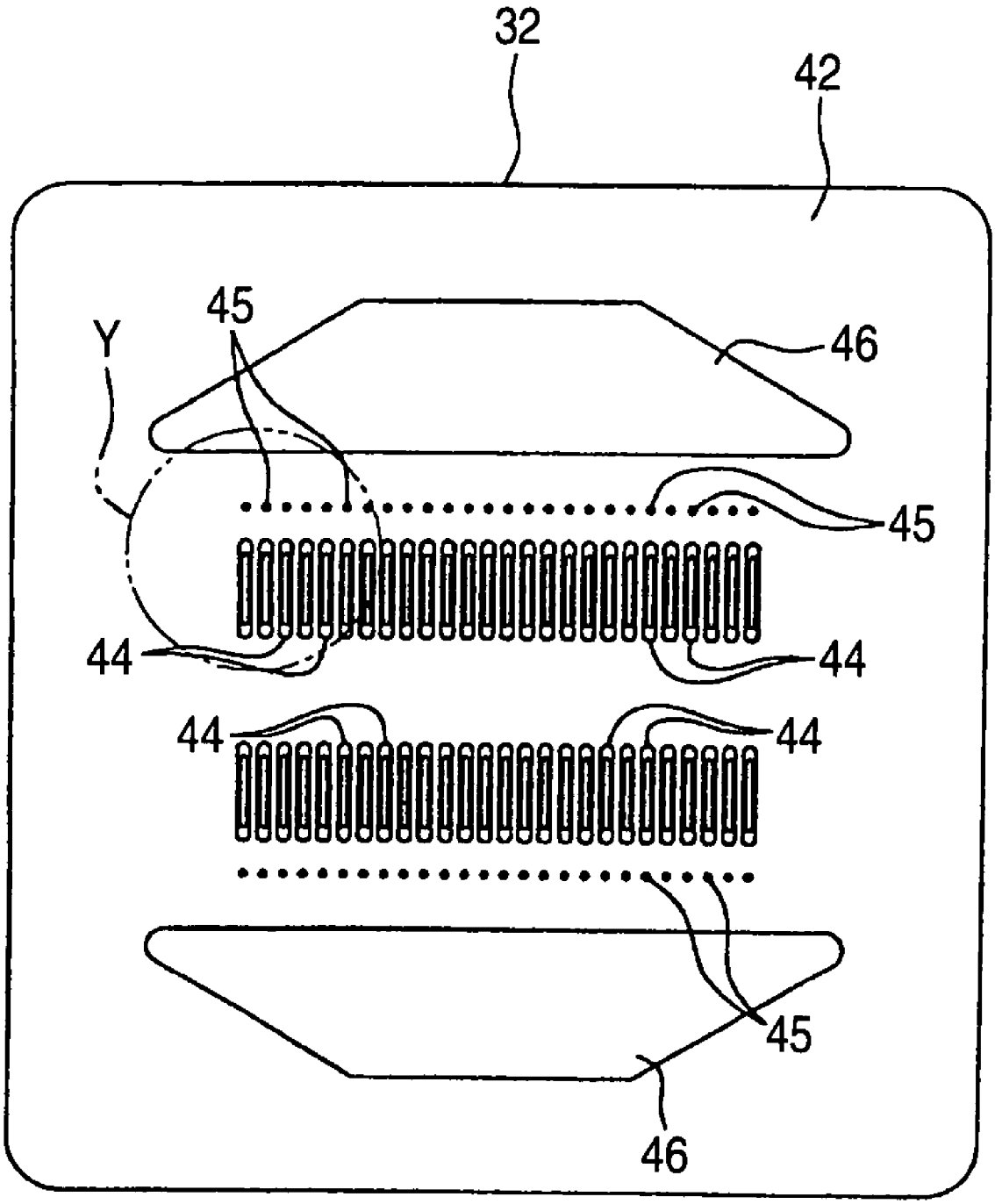
FIG. 6 is a plan view of an elastic plate.

As shown in FIG. 6, the elastic plate 32 is formed with a diaphragm portion 44, an ink supply port 45 and the compliance portion 46.

The diaphragm portion 44 is a portion for partitioning a portion of the pressure generating chamber 29. That is, the diaphragm portion 44 seals an opening face of the elongated recess portion 33 and forms to partition the pressure generating chamber 29 along with the elongated recess portion 33. As shown in FIG. 7A, the diaphragm portion 44 is of a slender shape in correspondence with the elongated recess portion 33 and is formed for each of the elongated recess portions 33 with respect to a sealing region for sealing the elongated recess portion 33. Specifically, a width of the diaphragm portion 44 is set to be substantially equal to the groove width of the elongated recess portion 33 and a length of the diaphragm portion 44 is set to be a slight shorter than the length of the elongated recess portion 33. With regard to the length, the length is set to be about two thirds of the length of the elongated recess portion 33. Further, with regard to a position of forming the diaphragm portion 44, as shown in FIG. 2, one end of the diaphragm portion 44 is aligned to one end of the elongated recess portion 33 (end portion on a side of the communicating port 34).

Figure 7B:
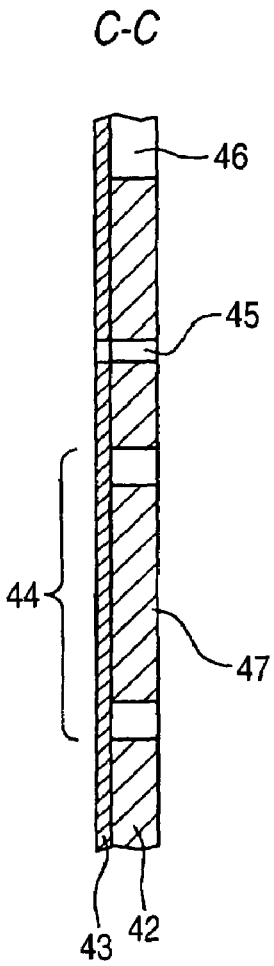
FIG. 7B is a sectional view taken along a line C—C of FIG. 7A.
Figure 7A:
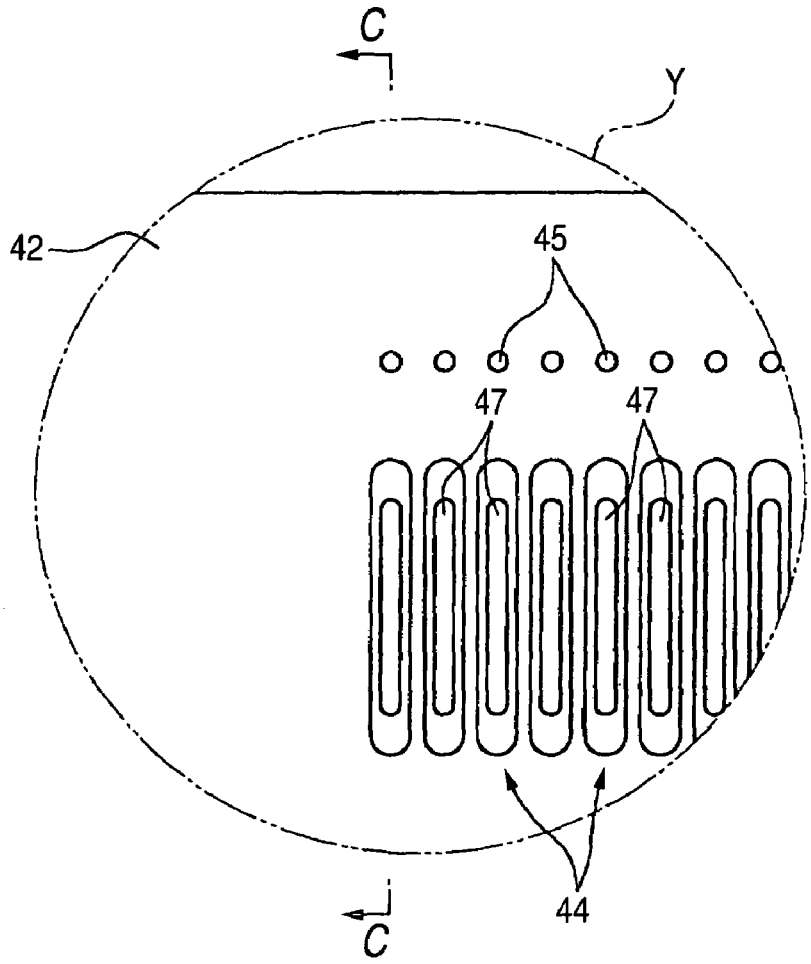
FIG. 7A is a view enlarging a Y portion of FIG. 6.

As shown in FIG. 7B, the diaphragm portion 44 is fabricated by removing the support plate 42 at a portion thereof in correspondence with the elongated recess portion 33 by etching or the like to constitute only the elastic film 43 and an island portion 47 is formed at inside of the ring. The island portion 47 is a portion bonded with a distal end face of the piezoelectric vibrator 10.

The ink supply port 45 is a hole for communicating the pressure generating chamber 29 and the common ink reservoir 14 and is penetrated in a plate thickness direction of the elastic plate 32. Similar to the diaphragm portion 44, also the ink supply port 45 is formed to each of the elongated recess portions 33 at a position in correspondence with the elongated recess portion 33. As shown in FIG. 2, the ink supply port 45 is bored at a position in correspondence with other end of the elongated recess portion 33 on a side opposed to the communicating port 34. Further, a diameter of the ink supply port 45 is set to be sufficiently smaller than the groove width of the elongated recess portion 33. According to the embodiment, the ink supply port 45 is constituted by a small through hole of 23 μm.

Reason of constituting the ink supply port 45 by the small through hole in this way is that flow path resistance is provided between the pressure generating chamber 29 and the common ink reservoir 14. That is, according to the recording head 1, an ink drop is ejected by utilizing a pressure variation applied to ink at inside of the pressure generating chamber 29. Therefore, in order to efficiently eject an ink drop, it is important that ink pressure at inside of the pressure generating chamber 29 is prevented from being escaped to a side of the common ink reservoir 14 as less as possible. From the view point, the ink supply port 45 is constituted by the small through hole.

Further, when the ink supply port 45 is constituted by the through hole as in the embodiment, there is an advantage that the working is facilitated and high dimensional accuracy is achieved. That is, the ink supply port 45 is the through hole, can be fabricated by laser machining. Therefore, even a small diameter can be fabricated with high dimensional accuracy and also the operation is facilitated.

The compliance portion 46 is a portion for partitioning a portion of the common ink reservoir 14. That is, the common ink reservoir 14 is formed to partition by the compliance portion 46 and the recess 15. The compliance portion 46 is of a trapezoidal shape substantially the same as an opening shape of the recess 15 and is fabricated by removing a portion of the support plate 42 by etching or the like to constitute only the elastic film 43.

Further, the support plate 42 and the elastic film 43 constituting the elastic plate 32 are not limited to the example. Further, polyimide may be used as the elastic film 43. Further, the elastic plate 32 may be constituted by a metal plate provided with a thick wall and a thin wall at a surrounding of the thick wall for constituting the diaphragm portion 44 and a thin wall for constituting the compliance portion 46.

Next, the above-described nozzle plate 31 will be explained. The nozzle plate 31 is a platelike member made of a metal aligned with a plurality of nozzle orifices 48 at a pitch in correspondence with a dot forming density. According to the embodiment, a nozzle row is constituted by aligning a total of 180 pieces of the nozzle orifices 48 and two rows of the nozzles are formed as shown in FIG. 2.

Further, when the nozzle plate 31 is bonded to other face of the chamber formation plate 30, that is, to a surface thereof on a side opposed to the elastic plate 32, the respective nozzle orifices 48 face the corresponding communicating ports 34.

Further, when the above-described elastic plate 32 is bonded to one surface of the chamber formation plate 30, that is, a face thereof for forming the elongated recess portion 33, the diaphragm portion 44 seals the opening face of the elongated recess portion 33 to form to partition the pressure generating chamber 29. Similarly, also the opening face of the dummy recess portion 36 is sealed to form to partition the dummy pressure generating chamber. Further, when the above-described nozzle plate 31 is bonded to other surface of the chamber formation plate 30, the nozzle orifice 48 faces the corresponding communicating port 34. When the piezoelectric vibrator 10 bonded to the island portion 47 is extended or contracted under the state, the elastic film 43 at a surrounding of the island portion is deformed and the island portion 47 is pushed to the side of the elongated recess portion 33 or pulled in a direction of separating from the side of the elongated recess portion 33. By deforming the elastic film 43, the pressure generating chamber 29 is expanded or contracted to provide a pressure variation to ink at inside of the pressure generating chamber 29.

When the elastic plate 32 (that is, the flow path unit 4) is bonded to the casing 2, the compliance portion 46 seals the recess 15. The compliance portion 46 absorbs the pressure variation of ink stored in the common ink reservoir 14. That is, the elastic film 43 is deformed in accordance with pressure of stored ink. Further, the above-described escaping recess portion 35 forms a space for allowing the elastic film 43 to be expanded.

The recording head 1 having the above-described constitution includes a common ink flow path from the ink supply needle 19 to the common ink reservoir 14, and an individual ink flow path reaching each of the nozzle orifices 48 by passing the pressure generating chamber 29 from the common ink reservoir 14. Further, ink stored in the ink cartridge is introduced from the ink supply needle 19 and stored in the common ink reservoir 14 by passing the common ink flow path. Ink stored in the common ink reservoir 14 is ejected from the nozzle orifice 48 by passing the individual ink flow path.

For example, when the piezoelectric vibrator 10 is contracted, the diaphragm portion 44 is pulled to the side of the vibrator unit 3 to expand the pressure generating chamber 29. By the expansion, inside of the pressure generating chamber 29 is brought under negative pressure, ink at inside of the common ink reservoir 14 flows into each pressure generating chamber 29 by passing the ink supply port 45. Thereafter, when the piezoelectric vibrator 10 is extended, the diaphragm portion 44 is pushed to the side of the chamber formation plate 30 to contract the pressure generating chamber 29. By the contraction, ink pressure at inside of the pressure generating chamber 29 rises and an ink drop is ejected from the corresponding nozzle orifice 48.

According to the recording head 1, the bottom face of the pressure generating chamber 29 (elongated recess portion 33) is recessed in the V-like shape. Therefore, the wall thickness of the proximal portion of the partition wall 28 for partitioning the contiguous pressure generating chambers 29 is formed to be thicker than the wall thickness of the distal end portion. Thereby, the rigidity of the thick wall 28 can be increased. Therefore, in ejecting an ink drop, even when a variation of ink pressure is produced at inside of the pressure generating chamber 29, the pressure variation can be made to be difficult to transmit to the contiguous pressure generating chamber 29. As a result, the so-called contiguous cross talk can be prevented and ejection of ink drop can be stabilized.

According to the embodiment, the ink supply port 45 for communicating the common ink reservoir 14 and the pressure generating chamber 29 is constituted by the small hole penetrating the elastic plate 32 in the plate thickness direction, high dimensional accuracy thereof is easily achieved by laser machining or the like. Thereby, an ink flowing characteristic into the respective pressure generating chambers 29 (flowing velocity, flowing amount or the like) can be highly equalized. Further, when th fabrication is carried out by the laser beam, the fabrication is also facilitated.

According to the embodiment, there are provided the dummy pressure generating chambers which are not related to ejection of ink drop contiguously to the pressure generating chambers 29 at end portions of the row (that is, a hollow portion partitioned by the dummy recess portion 36 and the elastic plate 32), with regard to the pressure generating chambers 29 at both ends, one side thereof is formed with the contiguous pressure generating chamber 29 and an opposed thereof is formed with the dummy pressure generating chamber. Thereby, with regard to the pressure generating chambers 29 at end portions of the row, the rigidity of the partition wall partitioning the pressure generating chamber 29 can be made to be equal to the rigidity of the partition wall at the other pressure generating chambers 29 at a middle of the row. As a result, ink drop election characteristics of all the pressure generating chambers 29 of the one row can be made to be equal to each other.

With regard to the dummy pressure generating chamber, the width on the side of the aligning direction is made to be wider than the width of the respective pressure generating chambers 29. In other words, the width of the dummy recess portion 36 is made to be wider than the width of the elongated recess portion 33. Thereby, ejection characteristics of the pressure generating chamber 29 at the end portion of the row and the pressure generating chamber 29 at the middle of the row can be made to be equal to each other with high accuracy.

According to the embodiment, the recess 15 is formed by partially recessing the front end face of the casing 2, the common ink reservoir 14 is formed to partition by the recess 15 and the elastic plate 32, an exclusive member for forming the common ink reservoir 14 is dispensed with and simplification of the constitution is achieved. Further, the casing 2 is fabricated by resin dieing, fabrication of the recess 15 is also relatively facilitated.

Next, a method of manufacturing the recording head 1 will be explained. Since the manufacturing method is characterized in steps of manufacturing the chamber formation plate 30, an explanation will be mainly given for the steps of manufacturing the chamber formation plate 30.

The chamber formation plate 30 is fabricated by forging by a progressive die. Further, a metal mother strip 55 (referred to as a "mother strip 55" in the following explanation) used as a material of the chamber formation plate 30 is made of nickel as described above.

The steps of manufacturing the chamber formation plate 30 comprises steps of forming the elongated recess portion 33 and steps of forming the communicating port 34 which are carried out by a progressive die.

Figure 8A:
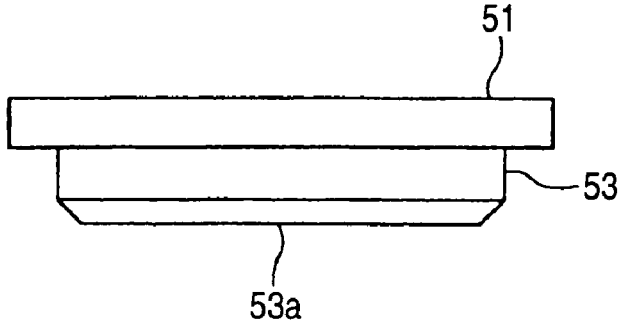
FIGS. 8A and 8B are views for explaining a first male die used in forming an elongated recess portion.
Figure 8B:
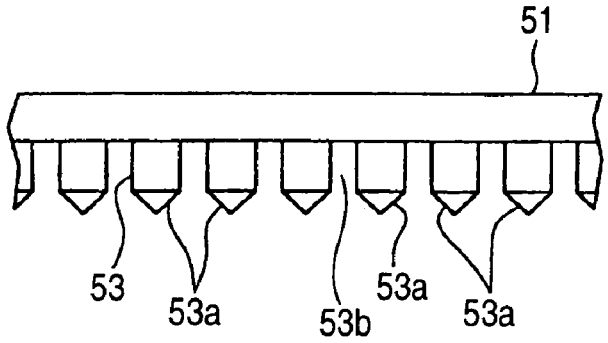
Figure 9A:
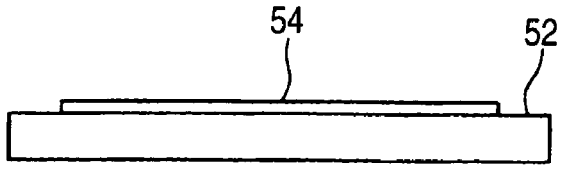
FIGS. 9A and 9B are views for explaining a female die used in forming the elongated recess portion.
Figure 9B:
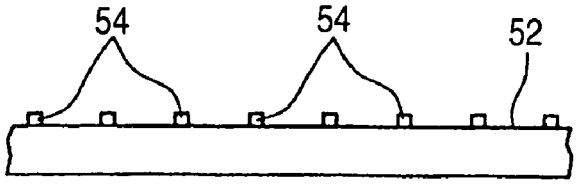

In the elongated recess portion forming steps, a first male die 51 shown in FIGS. 8A and 8B and a female die shown in FIGS. 9A and 9B are used. The first male die 51 is a die for forming the elongated recess portion 33. The male die is aligned with projections 53 for forming the elongated recess portions 33 by a number the same as that of the elongated recess portions 33. Further, the projections 53 at both ends in an aligned direction are also provided with dummy projections (not illustrated) for forming the dummy recess portions 36. A distal end portion 53*a* of the projection 53 is tapered from a center thereof in a width direction by an angle of about 45 degrees as shown in FIG. 8B. Thereby, the distal end portion 53*a* is sharpened in the V-like shape in view from a longitudinal direction thereof. Further, both longitudinal ends of the distal end portions 53A are tapered by an angle of about 45 degrees as shown in FIG. 8A. Therefore, the distal end portion 53*a* of the projection 53 is formed in a shape of tapering both ends of a triangular prism.

Further, the female die 52 is formed with a plurality of projections 54 at an upper face thereof. The projection 54 is for assisting to form the partition wall partitioning the contiguous pressure generating chambers 29 and is disposed between the elongated recess portions 33. The projection 54 is of a quadrangular prism, a width thereof is set to be a slight narrower than an interval between the contiguous pressure generating chambers 29 (thickness of partition wall) and a height thereof is set to a degree the same as that of the width. A length of the projection 54 is set to a degree the same as that of a length of the elongated recess portion 33 (projection 53).

Figure 10A:
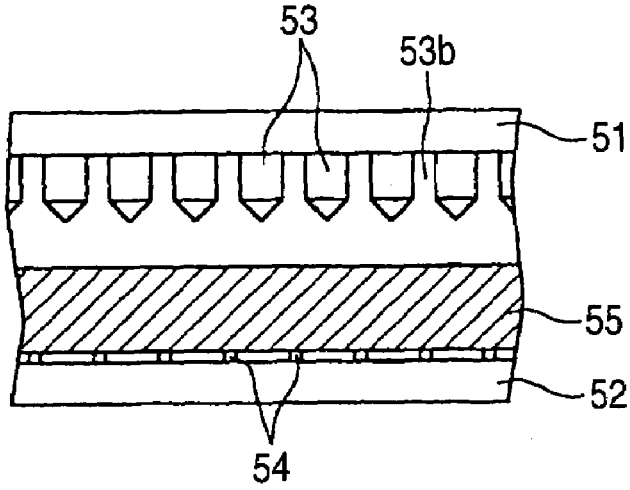
FIGS. 10A to 10C are views for explaining a step of forming the elongated recess portion.
Figure 10B:
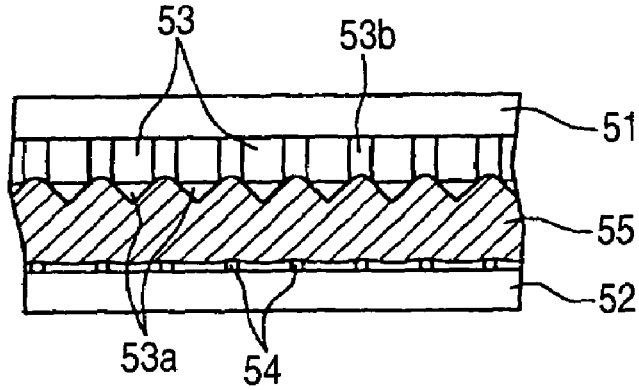
Figure 10C:
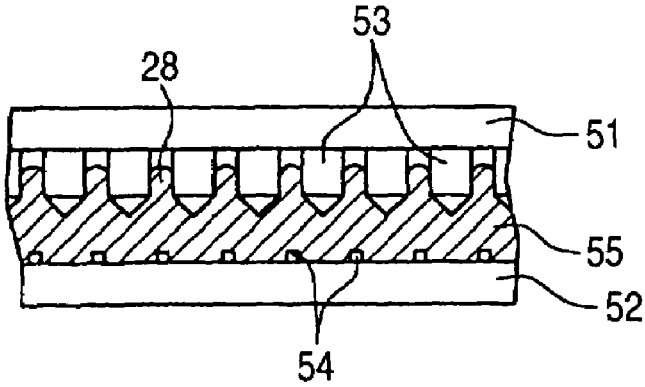

In the elongated recess portion forming steps, first, as shown in FIG. 10A, the mother strip 55 is mounted at an upper face of the female die 52 and the first male die 51 is arranged on an upper side of the mother strip 55. Next, as shown in FIG. 10B, the first male die 51 is moved down to push the distal end portion of the projection 53 into the mother strip 55. At this occasion, since the distal end portion 53*a* of the projection 53 is sharpened in the V-like shape, the distal end portion 53*a* can firmly be pushed into the mother strip 55 without buckling. Pushing of the projection 53 is carried out up to a middle in a plate thickness direction of the mother strip 55 as shown in FIG. 10C.

By pushing the projection 53, a portion of the mother strip 55 flows to form the elongated recess portion 33. In this case, since the distal end portion 53*a* of the projection 53 is sharpened in the V-like shape, even the elongated recess portion 33 having a small shape can be formed with high dimensional accuracy. That is, the portion of the mother strip 55 pushed by the distal end portion 53*a* flows smoothly, the elongated recess portion 33 to be formed is formed in a shape following the shape of the projection 53. Further, since the both longitudinal ends of the distal end portion 53*a* are tapered, the mother strip 55 pushed by the portions also flows smoothly. Therefore, also the both end portions in the longitudinal direction of the elongated recess portion 33 are formed with high dimensional accuracy.

Since pushing of the projection 53 is stopped at the middle of the plate thickness direction, the mother strip 55 thicker than in the case of forming a through hole can be used. Thereby, the rigidity of the chamber formation plate 30 can be increased and improvement of an ink ejection characteristic is achieved. Further, the chamber formation plate 30 is easily dealt with and the operation is advantageous also in enhancing plane accuracy.

A portion of the mother strip 55 is raised into a space between the contiguous projections 53 by being pressed by the projections 53. In this case, the projection 54 provided at the female die 52 is arranged at a position in correspondence with an interval between the projections 53, flow of the mother strip 55 into the space is assisted. Thereby, the mother strip 55 can efficiently be introduced into the space between the projections 53 and the protrusion (i.e., the partition wall 28) can be formed highly.

In such a step of forming the elongated recess portions 33 or the like, positioning of the mother strip 55 (mother plate) becomes important. That is, when forging is performed to the mother strip 55 to form the chamber formation plate 30, the relative position between the mother plate and the forging die must be accurately set. When this relative position is shifted, worked regions, that is, the elongated recess portions 33 to be the pressure generating chambers 29 are not positioned correctly on the mother plate, and accordingly, assembling accuracy at the time when the chamber formation plate 30 is assembled as the flow path unit 4 is deteriorated, and in an extreme case, there is an anxiety that a problem arises in the ejection performance of an ink droplet.

In order to settle the correct relative position between the mother strip 55 and the forging die, a reference hole for receiving a reference pin erected from the forging die is bored in the mother plate, and the reference pin enters the reference hole, so that the relative position between the worked region of the mother plate and the forging die is determined. In this case, when plastic working is performed to the worked region, plastic flow of the material occurs in the mother plate, and there is an anxiety that the reference hole is deformed by this displacement or its position becomes wrong.

The configuration for solving the above problem will be described below with reference to FIGS. 11A through 15B. Parts having the same function as those already described are designated by the same reference numerals in the drawings.

Figure 11A:
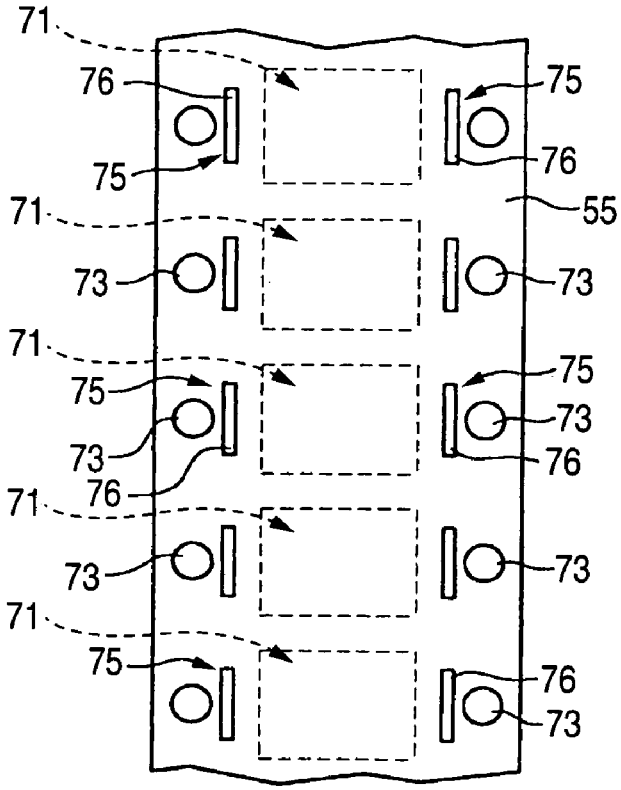
FIG. 11A is a plan view showing a mother strip according to a first example.
Figure 11B:
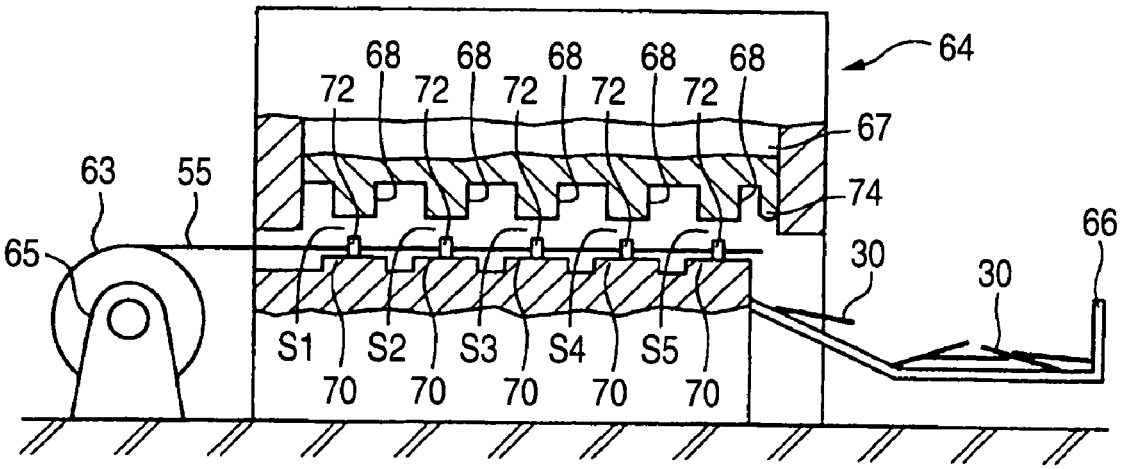
FIG. 11B is a partially sectional side view of a forging machine.

FIG. 11B schematically shows a state in which a sequentially sent band-like mother strip 55 is led out from a hoop 63 and fed to a forging machine 64 to be worked therein. Incidentally, the hoop 63 is supported by a rotation support apparatus (rewinder) 65, and a chamber formation plate 30 the working of which has been completed through predetermined working stages, is put in a receiving box 66.

In the forging machine 64, a slider 67 reciprocating in the vertical direction is equipped with plural male dies 68. Female dies 70 paired with the male dies 68 are disposed on a stationary table 69. In the forging machine 64, working stages S1, S2, S3, S4 and S5 are arranged in sequence from the left of FIG. 11B, and the male die 51 and the female die 52 shown in FIGS. 8A through 9B are arranged at the working stage S4 or S5.

In order to determine the position of the mother strip 55 sequentially sent to the respective working stages S1 to S5 and to set the relative position between a worked region 71 (see FIG. 11A) and the male die 68 or the female die 70, reference pins 72 are erected on the female die 70. Although not explicitly shown, a pair of the reference pins 72 are arranged for each of the working stages S1 to S5, and each pair of the reference pins 72 are arranged on a line extending orthogonal to a sequential feed direction of the mother strip 55. Accordingly, a pair of reference holes 73 shown in FIG. 11A are provided at both sides of each of the worked regions 71 corresponding to the respective working stages. Incidentally, the section of the reference pin 72 is circular, and the reference hole 73 is also circular.

A feeding mechanism for sequentially feeding the mother strip 55 to a next working stage is realized by a wellknown square motion, and when the mother strip 55 is lifted up and is separated from the reference pin 72, it is sent to a next working stage, and when it is lifted down, the next reference pins 72 relatively enter the reference holes 73 of the mother strip 55, and positioning for the next working is performed. The alignment of the reference pins 72 and the reference holes 73 attendant on such sequential feeding is simultaneously performed at the respective stages S1 to S5.

Incidentally, reference numeral 74 denotes a cutter used at final working, and the chamber formation plate 30 as one part is completed by this cutting.

Plastic working is performed on the mother strip 55 by the male die 51 and the female die 52 under condition of room temperature, and plastic working described below is performed similarly under condition of room temperature.

In the worked region 71, the elongated recess portions 33, the escaping recess portions 35, the communicating ports 34 or the like are formed, and in the working of these, plastic flow of the material occurs in the direction away from the worked region 71. When stress by such plastic flow of the material is transmitted to the reference holes 73, there occurs an anxiety that the reference holes 73 are deformed. If the reference holes 73 are deformed by such stress and become elliptical, they become difficult to pull out from the reference pins 72, and at the next working stage, on the contrary, it becomes difficult to make the reference pins 72 fit to the reference holes 73. Further, by the plastic flow of the material, the position of the reference hole 73 may be displaced in the direction away from the worked region 71.

In order to prevent the problematic phenomenon as described above, a deformation absorber 75 is formed in the mother strip 65 between the worked region 71 and the reference hole 73. In a first example shown in FIG. 11A, the deformation absorber 75 is formed as an elongated through hole 76 so as to transverse a portion between the worked region 71 and the reference hole 73.

The above described plastic flow of the material or the stress and displacement thereby is transmitted to the deformation absorber 75, and the deformation absorber 75 so deformed as to be contracted, so that the plastic flow of the material 55 is absorbed. Accordingly, the plastic flow of the material as stated above does not reach the reference hole 73, it is possible to prevent the reference hole 73 from deforming or the position from shifting, and the problems of the forming quality of the pressure generating chambers 29, the assembly quality of the flow path unit 4 or the like are solved.

Since the through hole 76 is elongated so as to transverse the portion between the worked region 71 and the reference hole 73, the deformation absorber 75 hardly exhibits reaction force to the plastic flow of the material 55 in the direction substantially orthogonal to the extending direction of the through hole 76, and carries out adaptable deformation absorption to cut off the influence on the reference hole 73.

Figure 12:
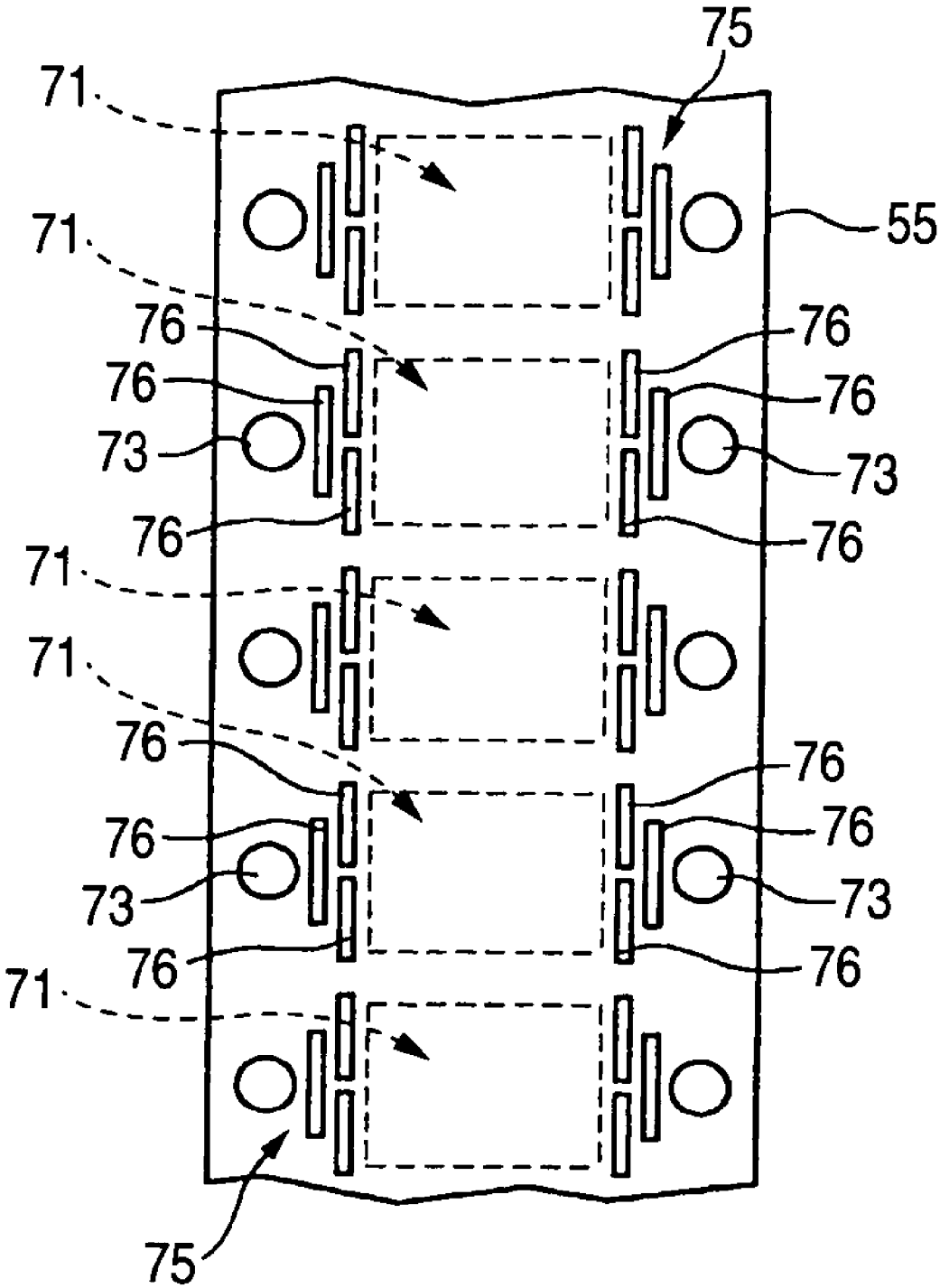
FIG. 12 is a plan view showing a mother strip according to a second example.

In a second example shown in FIG. 12, three through holes 76 are disposed at each portion between the worked region 71 and the reference hole 73. The two holes are arranged just adjacently to the worked region 71 in line, and the one hole is adjacently arranged at the side thereof. Accordingly, since the adaptable deformation absorption hardly exhibiting the reaction force is carried out by the plural holes 76, the influence on the reference hole 73 can be more certainly cut off.

In the progressive type forging machine 64 as shown in FIG. 11B, the working sequence of the respective parts is, for example, such that the reference holes 73 and the through holes 76 are simultaneously bored at the working stage S1, and then, preliminary forming of the elongated recess portions 33 is performed at the working stage S2, and further, finish forming of the elongated recess portions 33 is performed at the working stage S3, and progresses to the final step. That is, with respect to the worked region 71, the working sequentially progresses as the working stages sequentially progress. Incidentally, the male die 51 and the female die 52 are attached to the place of the working stage S2 or S3.

In such progressive system, since the plastic flow of the material 55 from the worked region 71 is absorbed by the through holes 76 at each of the working stages, deformation of the reference hole 73 is prevented and the correct position can be kept also in subsequent working stages as described layer.

In the worked region 71, the working is completed by performing the plastic working plural times, and since the plastic flow generated each time the plastic working is performed is absorbed by the through holes 76 and the position accuracy of the reference holes 73 can be kept, the shape accuracy and dimension accuracy of the worked region 71 completed by performing the plastic working plural times, that is, the accuracy of the pressure generating chambers 29, the recesses 35 or the like can be enhanced.

The working of the respective parts actually progresses by the progressive type forging machine 64 as shown in FIG.

Figure 13:
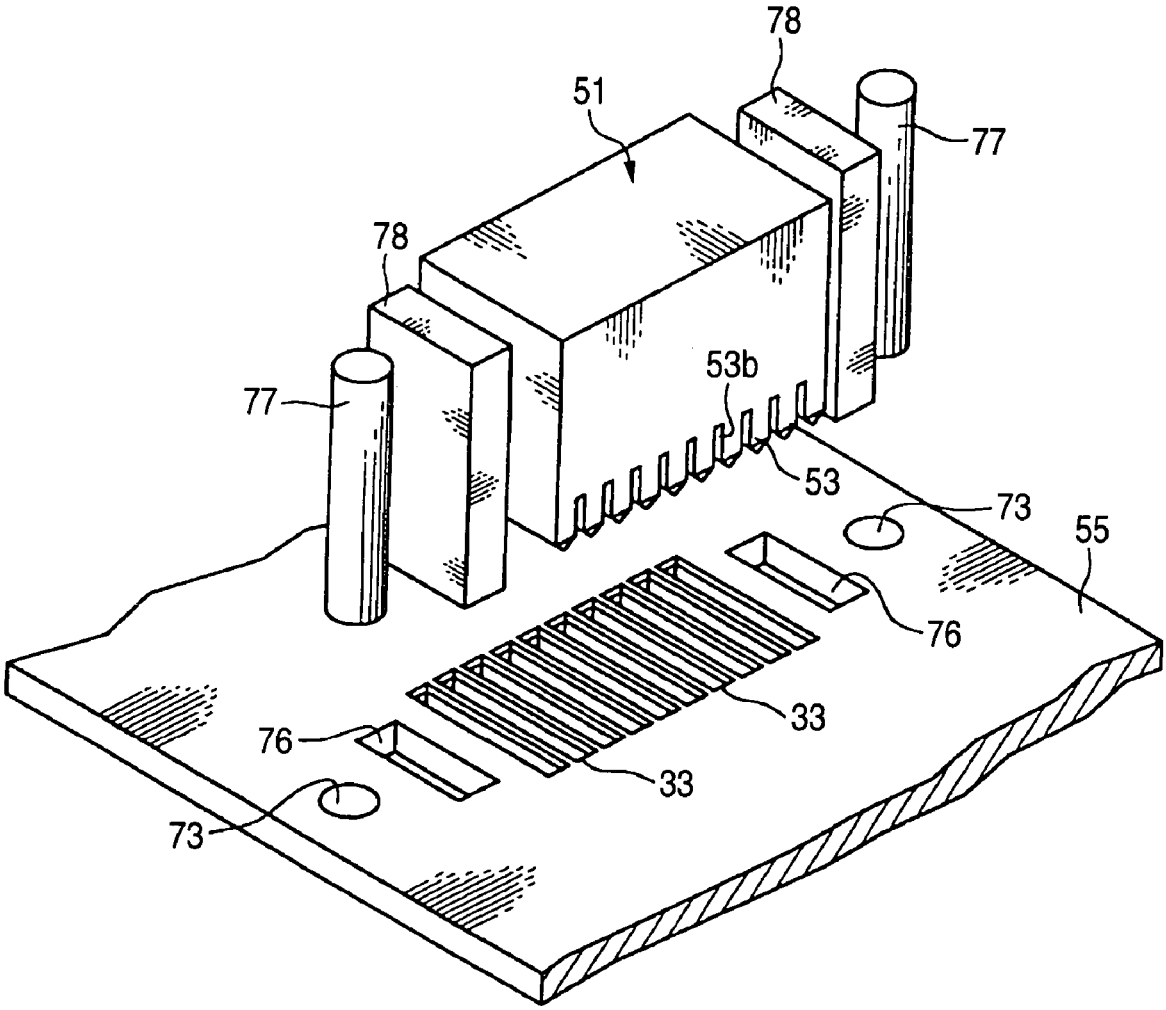
FIG. 13 is a perspective view showing a positional relationship among the mother strip and various dies.

11B, on the other hand, FIG. 13 collectively shows various dies disposed at the respective working stages. A punch 77 for boring the reference hole 73, and a punch 78 for boring the through hole 76 are mounted at the working stage S1, the male die 51 and the female die 52 for preliminary forming are mounted at the working stage S2, and those for finish forming are mounted at the working stage S3.

The timing when the through hole 76 is bored is earlier than the forming of the worked region 71. By doing so, when the plastic flow of the material occurs from the worked region 71, since the through hole 76 is already prepared, the plastic flow of the material 55 is certainly blocked by the through hole 76, and factors to cause deformation of the reference hole 73 and misalignment of its position can be certainly removed. Besides, since the through hole 76 is bored simultaneously with at least the reference hole 73 before the worked region 71 is subjected to the working, the plastic flow of the material 55 from the worked region 71 is certainly blocked, and the time required to bore the through hole 76 and the reference hole 73 is shortened.

Figure 14:
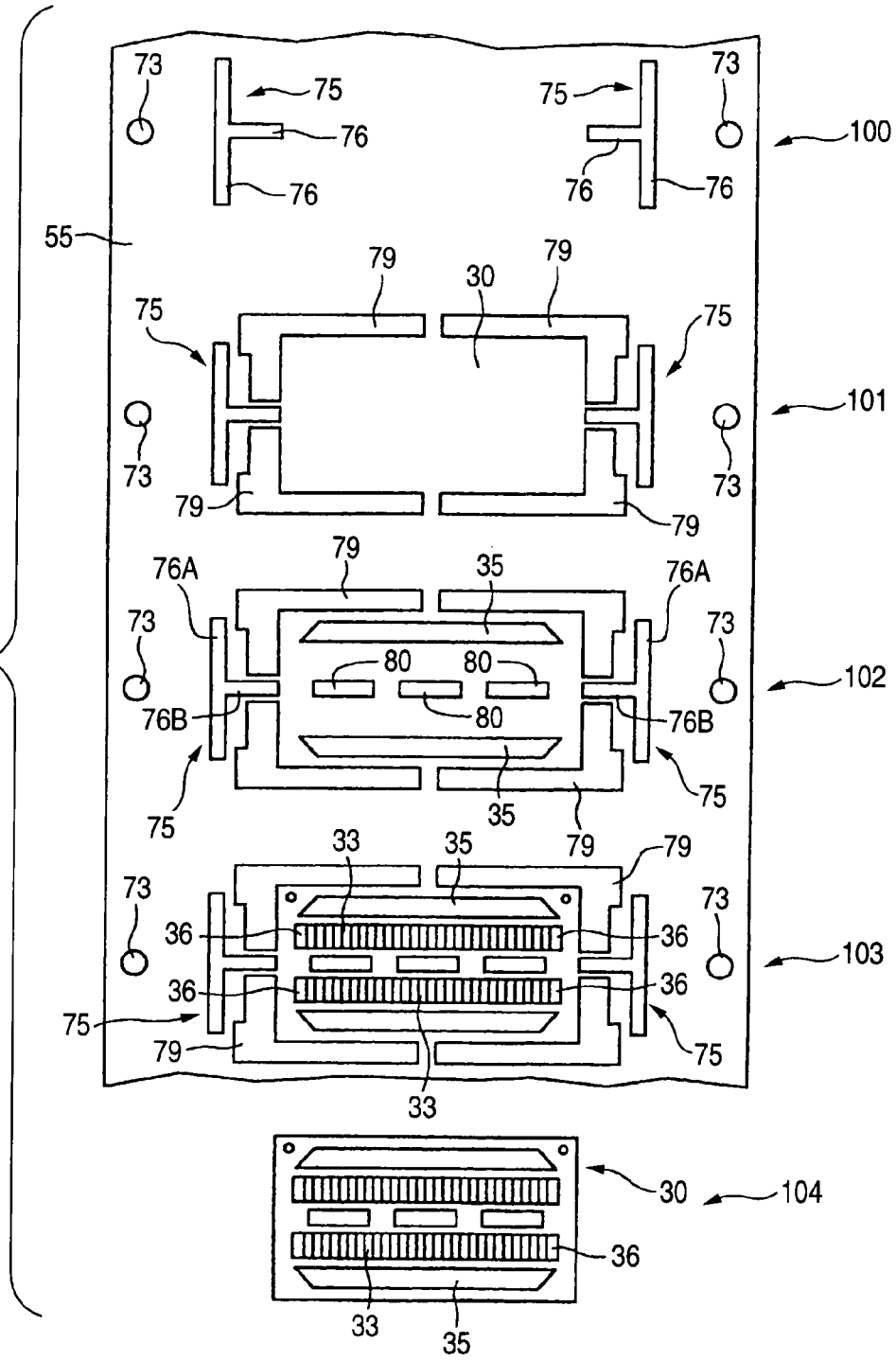
FIG. 14 is a plan view of the mother strip for explaining sequentially progressing working stages.

FIG. 14 shows a state in which the working sequentially progresses for the mother strip 55. In other words, the mother strip 55 is removed from the forging machine 64 of FIG. 11B, and the progress of the respective working stages is shown. A numeral 100 shows a state in which the reference hole 73 and the through hole 76 are punched by the punches 77 and 78. A numeral 101 shows a state in which substantially L-shaped openings 79 for trimming are punched at four places to define a region to be the chamber formation plate 30. A numeral 102 shows a state in which the escaping recess portions 35 are formed and punching holes 80 for decreasing a polishing area are formed. A numeral 103 shows a state in which the elongated recess portions 33 to be the pressure generating chambers 29 are formed, the pressure generating chambers 29 are arranged side by side so that two rows of the pressure generating chambers 29 are formed. Besides, the dummy pressure generating chambers 36 are formed at both ends of each row of the pressure generating chambers 29. A numeral 104 shows a state in which trimming is performed and the pressure generating chamber 30 is completed.

The T-shaped through hole shown in FIG. 14 is a third example. Such a shape is selected so as to adaptively receive the plastic flow of the material generated in accordance with the shape of the worked region 71. A vertical long part 76A mainly serves to cut off the influence of the plastic flow on the reference hole 73, and in order to compensate that, a horizontal short part 76B is provided. That is, since the deformation of only the long part 76A is insufficient, the short part 76B is added, and the deformation as the whole of the through holes 76A and 76B is increased.

Since stress at the time when the openings 79 is formed may act in the vertical direction of the figure, such a stress can be mainly absorbed by the horizontal short part 76B.

Namely, the shape of the through hole 76 may be arbitrarily selected in accordance with the state (direction or amount) of the plastic flow of the material generated according to the shape of the worked region 71 in order to attain the highest efficiency of absorbing the deformation. Accordingly, the deformation absorber 75 may be made oblong, elliptical, or arc-shaped to form the optimum shape.

Figure 15A:
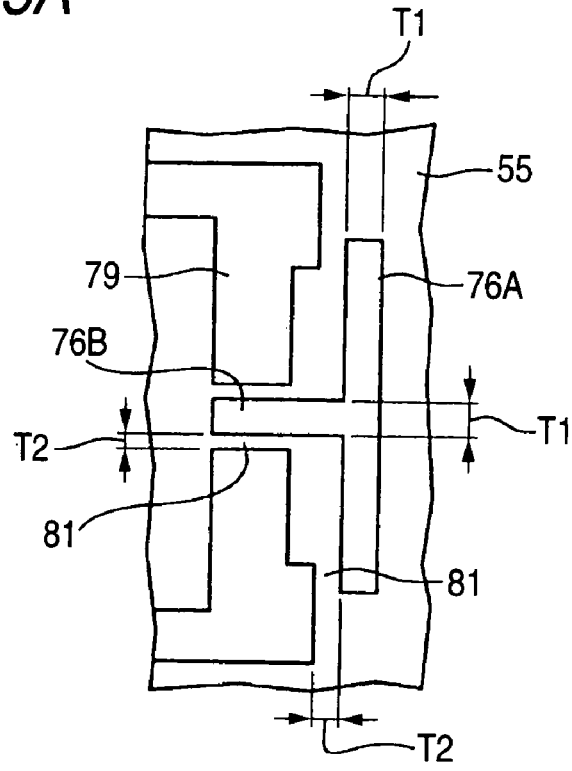
FIG. 15A is an enlarged plan view showing a mother strip according to a third example.

FIG. 15A shows a fourth example where the width T1 of a through hole 76 is made larger than the width T2 of a connection part 81 for connecting the worked region 71 and the mother strip 55 (T1>T2). With such a configuration, since the stress, which may otherwise concentrate on the connection part 81 to be generally made narrow, concentrates on the through hole 76 with the width larger than the width of the connection part 81, breakage or the like of the thin connection part 81 is prevented.

Figure 15B:
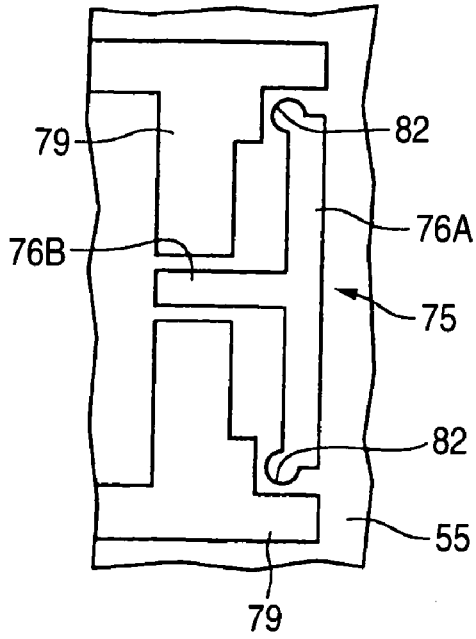
FIG. 15B is an enlarged plan view showing a mother strip according to a fourth example.

In a fifth example shown in FIG. 15B, an arcuate part 82 is formed at a corner of a long part 76A. Here, the arcuate part 82 is placed to one side where stress is apt to concentrate. That is, since the width of the through hole 76 is contracted and restored by the plastic flow of the material 55 from the worked region 71, stress concentration repeatedly acts on the end of the through hole 76, and when the number of times of this repetition becomes excessive, the end of the through hole 76 is cracked, and in the worst case, there is an anxiety that it is broken and the working becomes impossible. Since the arcuate part 82 relieves such concentration of stress, the problem of crack initiation or the like is completely resolved.

The mother strip 55 is set to have a predetermined size, and by forming a predetermined number of chamber formation plates 30 in this mother strip 55, the deformation or the like of the reference hole 73 is prevented for each of the mother plates 55 on which the respective chamber formation plates 30 are formed, and accurate positioning function is accomplished for each of the mother plates 55.

The mother plate may be a pre-cut plate in which at least one chamber formation plate 30 is to be formed, and may be progressed in the forging machine 64 in the same manner as described the above.

The elongated recess portions 33 are arranged at a predetermined pitch. Since the projections 53 of the male die 51 for forming the elongated recess portions 33 are arranged at a predetermined pitch, the amount of plastic flow of the mat rial 55 generated by the press-molding becomes uniform, so that load for absorbing displacement or the like by the through hole 76 is also equalized.

A pitch dimension of the elongated recess portions 33 is 0.14 mm. When the pressure generating chamber 29 of the ink jet recording head, which is a precise minute member, is forged, very elaborate forging work is possible. Though the pitch dimension of the elongated recess portions 33 is 0.14 mm in the shown embodiment, by setting this pitch 0.3 mm or less, the parts work of the liquid ejection head is finished more suitably. This pitch is preferably 0.2 mm or less, and more preferably 0.15 mm or less.

As a working method for such minute structure, an anisotropic etching method is generally adopted. However, since this method requires a large number of working steps, it is disadvantage in manufacturing cost. On the contrary, in a case where the above forging work method is used in the material such as nickel, the number of working steps is reduced greatly, which is very advantageous in cost.

Figure 16:
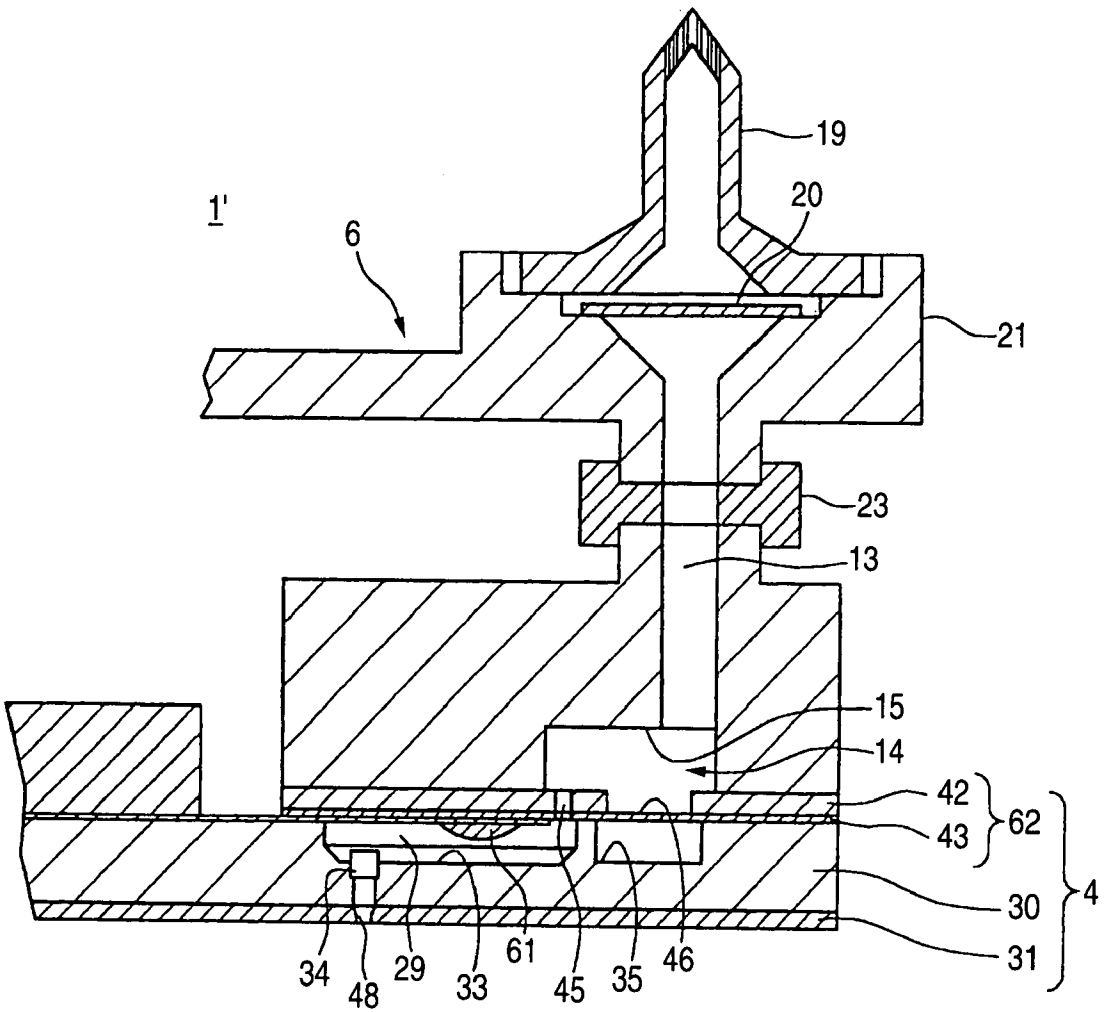
FIG. 16 is a sectional view for explaining an ink jet recording head according to a second example.

As a second example, a recording head 1' shown in FIG. 16 adopts a heat generating element 61 as the pressure generating element. According to the embodiment, in place of the elastic plate 32, a sealing board 62 provided with the compliance portion 46 and the ink supply port 45 is used and the side of the elongated recess portion 33 of the chamber formation plate 30 is sealed by the sealing board 62. Further, the heat generating element 61 is attached to a surface of the sealing board 62 at inside of the pressure generating chamber 29. The heat generating element 61 generates heat by feeding electricity thereto via an electric wiring.

Since other constitutions of the chamber formation plate 30, the nozzle plate 31 and the like are similar to those of the above-described embodiments, explanations thereof will be omitted.

In the recording head 1', by feeding electricity to the heat generating element 61, ink at inside of the pressure generating chamber 29 is bumped and bubbles produced by the bumping presses ink at inside of the pressure generating chamber 29, so that ink drops are ejected from the nozzle orifice 48.

Even in the case of the recording head 1', since the chamber formation plate 30 is fabricated by plastic working of metal, advantages similar to those of the above-described embodiments are achieved.

With regard to the communicating port 34, although according to the above-described embodiments, an example of providing the communicating port 34 at one end portion of the elongated recess portion 33 has been explained, the invention is not limited thereto. For example, the communicating port 34 may be formed substantially at center of the elongated recess portion 33 in the longitudinal direction and the ink supply ports 45 and the common ink reservoirs 14 communicated therewith may be arranged at both longitudinal ends of the elongated recess portion 33. Thereby, stagnation of ink at inside of the pressure generating chamber 29 reaching the communicating port 34 from the ink supply ports 45 can be prevented.

Further, although according to the above-described embodiments, an example of applying the invention to the recording head used in the ink jet recording apparatus has been shown, an object of the liquid ejection head to which the invention is applied is not constituted only by ink of the ink jet recording apparatus but glue, manicure, conductive liquid (liquid metal) or the like can be ejected.

What is claimed is:

1. A method of manufacturing a chamber formation plate of a liquid ejection head, including a first region adapted to be formed with at least communicating ports passing through the chamber formation plate and recess portions adapted to be pressure generating chambers communicated with nozzles, from which liquid droplets are ejected by pressure generated in the pressure generating chambers, through the communicating ports, the method comprising steps of:

providing a metal plate and a forging die including a first forging die and a second forging die;

providing a reference part on the metal plate, the reference part securing a relative position between the first region and the forging die;

providing at least one deformation absorber, at a second region of the metal plate, between the first region and the reference part; and performing at least two plastic working by the first forging die and the second forging die, with respect to the first region to form at least the recess portions and the communicating ports, while plastic deformation of the metal plate caused by the plastic working is absorbed by the deformation absorber, wherein the step of providing the deformation absorber is performed before the step of performing at least the two plastic working.

2. The manufacturing method as set forth in claim 1, wherein the step of providing the deformation absorber includes a step of forming a through hole in the metal plate.

3. The manufacturing method as set forth in claim 2, wherein the step of providing the deformation absorber includes a step of determining a shape of through hole in accordance with a condition of the plastic deformation to be caused by the plastic working.

4. The manufacturing method as set forth in claim 2, wherein the through hole is so formed as to extend in a direction substantially perpendicular to a direction in which the plastic deformation transmits.

5. The manufacturing method as set forth in claim 1, wherein the step of providing the reference part and the step of providing the deformation absorber are performed simultaneously.

6. The manufacturing method as set forth in claim 1, wherein the metal plate is provided as a continuous strip to be eventually cut into a plurality of chamber forming plates.

7. The manufacturing method as set forth in claim 1, wherein the metal plate is provided as a pre-cut plate to eventually be the chamber formation plate.

8. The manufacturing method as set forth in claim 1, wherein the step of providing the reference part includes a step of forming a through hole to which a reference pin provided in the forging die is to be inserted.

9. The manufacturing method as set forth in claim 1, wherein the recess portions are arranged at a fixed interval.

10. The manufacturing method as set forth in claim 9, wherein the interval is 0.3 mm or less.

* * * * *